US005611175A

United States Patent [19]

Sweers

[11] Patent Number: 5,611,175

[45] Date of Patent: Mar. 18, 1997

[54] GUTTER-SCREEN CONNECTING CLIP

[76] Inventor: Ronald L. Sweers, 6165 E. Atherton Rd., Burton, Mich. 48519

[21] Appl. No.: 630,586

[22] Filed: Apr. 10, 1996

[51] Int. Cl.[6] ..... E04D 13/068

[52] U.S. Cl. ..... 52/12; 24/457; 24/336

[58] Field of Search ..... 52/12, 11, 15; 24/457, 458, 336

[56] References Cited

U.S. PATENT DOCUMENTS

| | | |
|---|---|---|
| 706,333 | 8/1902 | Meuser . |
| 956,372 | 4/1910 | Kreutzberg . |
| 2,948,083 | 8/1960 | Steele . |
| 3,067,881 | 12/1962 | Goosmann . |
| 3,351,206 | 11/1967 | Wennerstrom . |
| 3,367,070 | 2/1968 | Mitchell . |
| 3,388,555 | 6/1968 | Foster . |
| 3,420,378 | 1/1969 | Turner . |
| 3,834,091 | 9/1974 | Dugan . |
| 4,036,761 | 7/1977 | Rankin . |
| 4,553,356 | 11/1985 | Pepper . |
| 4,727,689 | 3/1988 | Bosler . |
| 4,750,300 | 6/1988 | Winger, Jr. . |
| 4,841,686 | 6/1989 | Rees . |
| 4,888,920 | 12/1989 | Marulic . |
| 4,941,299 | 7/1990 | Sweers . |
| 4,959,932 | 10/1990 | Pfeifer . |
| 5,044,581 | 9/1991 | Dressler . |
| 5,056,276 | 10/1991 | Nielsen et al. . |
| 5,072,551 | 12/1991 | Manoogian, Jr. . |
| 5,095,666 | 3/1992 | Williams, Jr. . |
| 5,181,350 | 1/1993 | Meckstroth . |
| 5,271,192 | 12/1993 | Nothum, Sr. et al. . |

*Primary Examiner*—Carl D. Friedman
*Assistant Examiner*—Timothy B. Kang
*Attorney, Agent, or Firm*—Gifford, Krass, Groh, Sprinkle, Patmore, Anderson & Citkowski, P.C.

[57] ABSTRACT

A gutter screen connecting clip is designed to uniquely engage the upwardly extending side wall of a gutter and to provide a locking tang engagement with connecting flanges of a screen guard.

3 Claims, 1 Drawing Sheet

GUTTER-SCREEN CONNECTING CLIP

BACKGROUND OF THE INVENTION

1. Field of the Invention

This invention relates to rain gutters, and, more particularly this invention relates to a connecting clip for installing an efficient gutter screen to gutter types such as a hemispherically-shaped gutter.

2. State of the Prior Art

Guard screens are designed to prevent leaves and other debris from entering the open top of the gutter while allowing the rain water passing from the roof to freely enter the gutter. The guard screen should not only prevent the leaves and other foreign matter from entering the gutter, but it should also present a sloped surface for deflecting this material off the screen. The screen should also preferably prevent water flow from the building eave between the gutter and the fascia board. Finally the gutter screen should be detachable along one of its longitudinal sides to allow the gutter to be cleaned of accumulated debris.

In my U.S. Pat. No. 5,555,680 issued Sep. 17, 1996 entitled GUARD SCREEN FOR A RAIN GUTTER HAVING FLANGES FOR GRIPPING THE FRONT LIP OF A GUTTER, I have set forth a brief history of the development of gutter guard screens from the common metal screen types through extruded plastic types.

The gutter screens presented in my above-mentioned issued U.S. Patent and in my issued U.S. Pat. No. 4,941,299 have the desirable features mentioned above as they are applied to the front lip of a "K-style" gutter. The hemispherically-shaped gutter shown in U.S. Pat. No. 4,553,356 to Pepper and mentioned in my U.S. Pat. No. 5,555,680 has a pair of spaced ribs forming channels on the inwardly facing walls of the gutter to receive the sides of a gutter screen. This type of installation lacks the obvious advantages of my gutter screens.

SUMMARY OF THE PRESENT INVENTION

The present invention provides a connecting clip for attaching the improved gutter screen of my U.S. Pat. No. 5,555,680 to a rain gutter which has at least one rib on an inwardly facing wall of the gutter.

The connecting clip has a longitudinally extending, downwardly opening channel having an outer leg terminating in a first inwardly projecting flange and an inner leg having a second inwardly and upwardly extending flange. The channel of the connecting clip can be snapped over the upwardly extending outer wall of the gutter with the first flange engaging an outer surface of the outer wall and the second flange engaging a lower surface of the gutter rib.

The connecting clip has a third flange extending inwardly from the channel which terminates in a tang for engagement with a connecting flange of the guard screen.

In a preferred embodiment of the invention, the third flange of the connecting clip extends above the channel generally parallel to a bight portion of the channel which joins the outer and inner legs of the channel. The tang has a downwardly extending prong which coacts with an upwardly extending connecting flange at the end of an arm on the guard screen with the arm being trapped between the prong and the bight portion.

Also in a preferred embodiment of the invention, the tang has an upwardly and downwardly extending prong for engaging upwardly and downwardly extending connecting flanges on the guard screen.

BRIEF DESCRIPTION OF THE DRAWING

The advantages of the present invention will be more apparent from the following detailed description when considered in connection with the accompanying drawing wherein.

DETAILED DESCRIPTION OF THE PREFERRED EMBODIMENT

Figure 1:
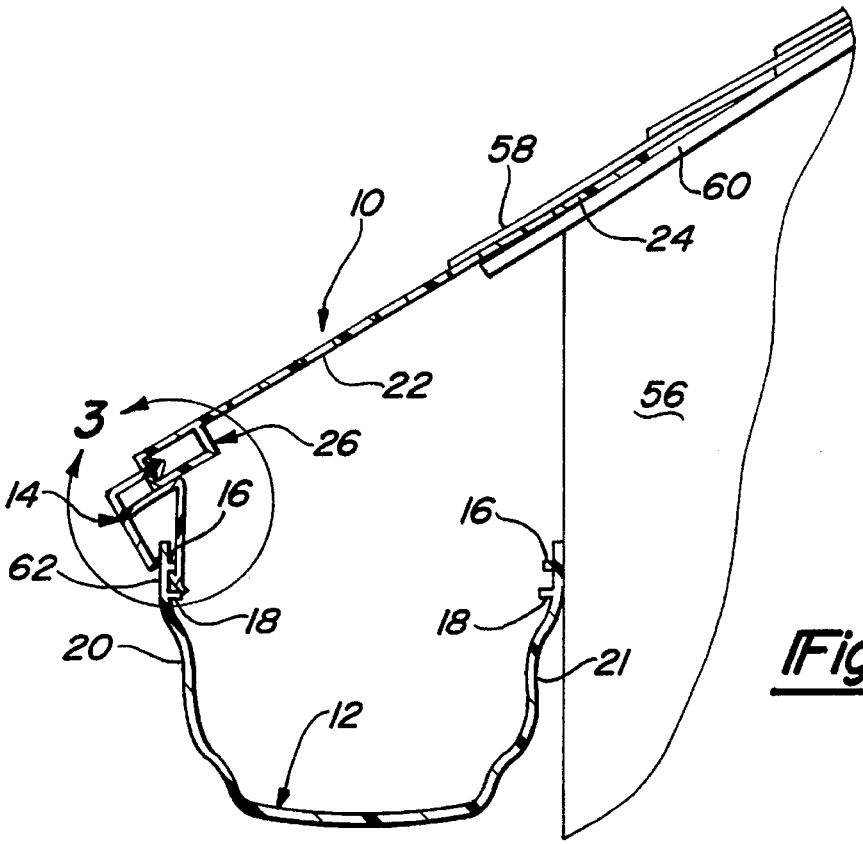
FIG. 1 is a cross-sectional view of a gutter with a guard screen held in place by the connecting clip of the present invention.
Figure 2:
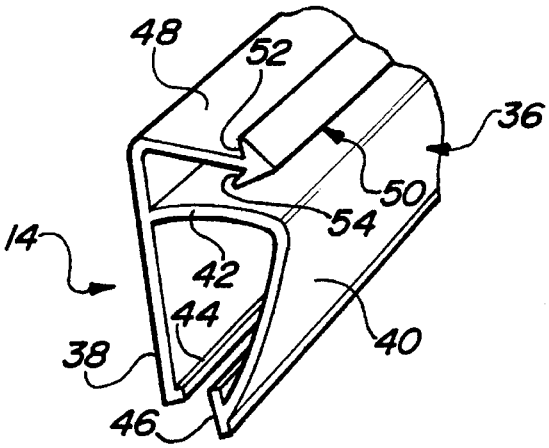
FIG. 2 is a perspective view of the connecting clip.
Figure 3:
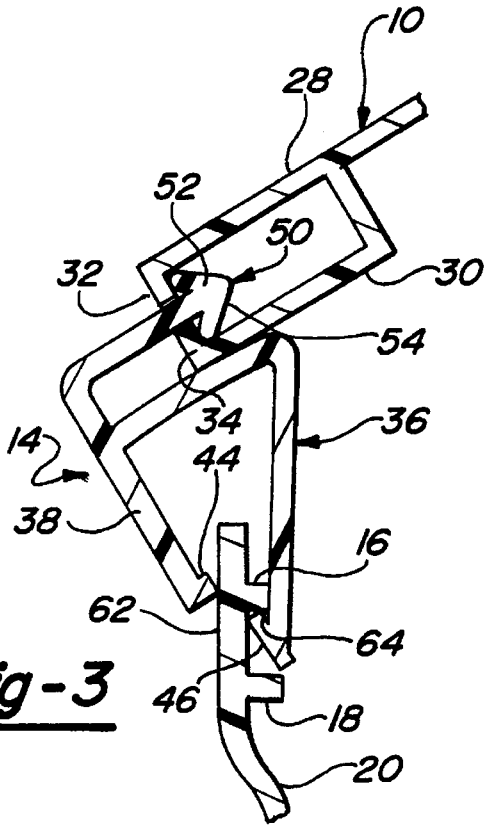
FIG. 3 is a cross-sectional view on an enlarged scale of the area encircled in FIG. 1.

Referring to FIG. 1, a guard screen 10 is shown attached to a rain gutter 12 by the connecting clip 14 of the invention. The gutter 12 is a hemispherically-shaped gutter having inwardly projecting upper and lower longitudinally extending ribs 16 and 18 on its outer and inner side walls 20 and 21.

The screen guard 10 has a central perforate planar body 22 with an imperforate edge flange 24 on one side and a connecting channel 26 on its other side. The connecting channel has an upper and a lower arm 28 and 30 with downwardly and upwardly extending connecting flanges 32 and 34 respectively. The details of this screen guard are set forth in my previously mentioned U.S. Pat. No. 5,555,680.

The connecting clip 14 of the present invention is shown as having a longitudinally extending downwardly opening channel 36 having an outer leg 38 and an inner leg 40 joined by a bight portion 42 at their upper ends. The lower free end of outer leg 38 terminates in a first inwardly projecting flange 44, and the lower free end of inner leg 40 terminates in a second inwardly and upwardly projecting flange 46. In the illustrated preferred form of the invention, the outer leg 38 continues upwardly past the bight portion 42 to an inwardly projecting third flange 48 over and parallel to bight portion 42. The third flange 48 terminates in a tang 50 having an upwardly extending prong 52 and a downwardly extending prong 54.

The rain gutter 12 is attached to the fascia board 56 of a building eave in a conventional manner, as by the use of nails, not shown, passing through the upper ends of the gutter side walls 20 and 21. Edge flange 24 of the screen guard 10 is inserted between shingles 58 and roof boards 60.

The channel 36 of connecting clip 14 can be snapped over the upper end 62 of the outer gutter side wall 20 with the first inwardly projecting flange 44 engaging the outer surface of the side wall 20, and the second inwardly and upwardly projecting flange 46 engaging the under side 64 of the upper gutter rib 16. Once the clip 14 is snapped onto the gutter 12, it will be difficult if not impossible to remove the clip without tools, but it can be easily slid along the upper edge of the gutter. The connecting clip 14 will have a relatively short length, usually not more than a nominal three inches whereas the screen guards are conventionally supplied in nominal three foot long lengths.

The screen guard 10 is attached to the connecting clip 14 by sliding the clip 14 along the gutter to engage the tang 50 of the clip in the channel 26 of the screen guard. The upwardly and downwardly extending prongs of tang 50 will engage the downwardly and upwardly extending connecting flanges 32 and 34 of the guard screen as a limit with the lower arm 30 of the guard screen channel being trapped between the downwardly extending prong 54 of the tang 50 and the bight portion 42 of the connecting clip channel 36.

While the connecting clip 14 provides a very secure fastening of the guard screen to the gutter, it also provides easy detachment of the guard screen from the gutter by sliding the clip along the gutter so that the screen can be pivoted upwardly to clean the gutter trough.

I claim:

1. In combination with a longitudinally extending rain gutter having an upwardly extending outer wall with at least one rib on an upper portion of an inwardly facing surface of said outer wall and a guard screen connecting roof boards to said gutter, said gutter having a front lip, a connecting clip comprising:

a longitudinally extending, downwardly opening channel having an outer leg member terminating in a first inwardly projecting flange and an inner leg having a second inwardly and upwardly extending flange;

wherein the channel of said connecting clip is snapped over the upwardly extending outer wall of said gutter with said first flange engaging an outer surface of said outer wall and said second flange engaging a lower surface of said rib;

said connecting clip having a third flange extending inwardly from said channel and terminating in a tang engaging a connecting flange of said guard screen.

2. The combination according to claim 1 wherein said third flange of said connecting clip extends above said channel generally parallel to a bight portion of said channel which joins said outer and inner legs of said channel, said tang having a downwardly extending prong and said guard screen having an upwardly extending connecting flange at the end of an arm wherein when said prong engages said connecting flange, said arm is trapped between said prong and said bight portion.

3. The combination according to claim 1 wherein said tang of said connecting clip has an upwardly extending prong and a downwardly extending prong engaging upwardly and downwardly extending connecting flanges on said guard screen.

* * * * *